US009114508B2

(12) United States Patent
Antonio

(10) Patent No.: US 9,114,508 B2
(45) Date of Patent: Aug. 25, 2015

(54) OIL FILTER WRENCH

(71) Applicant: Ronald Fontanilla Antonio, Woodland, CA (US)

(72) Inventor: Ronald Fontanilla Antonio, Woodland, CA (US)

( * ) Notice: Subject to any disclaimer, the term of this patent is extended or adjusted under 35 U.S.C. 154(b) by 121 days.

(21) Appl. No.: 13/694,367

(22) Filed: Nov. 26, 2012

(65) Prior Publication Data

US 2014/0144297 A1 May 29, 2014

Related U.S. Application Data

(60) Provisional application No. 61/744,438, filed on Sep. 26, 2012.

(51) Int. Cl.

| | |
|---|---|
| ***B25B 13/18*** | (2006.01) |
| ***B25B 13/12*** | (2006.01) |
| ***B25B 13/44*** | (2006.01) |
| ***B25B 27/00*** | (2006.01) |
| *B25B 13/50* | (2006.01) |
| *B25B 13/46* | (2006.01) |

(52) U.S. Cl.
CPC ..... *B25B 13/44* (2013.01); *B25B 13/12* (2013.01); *B25B 13/18* (2013.01); *B25B 27/0042* (2013.01); *B25B 13/46* (2013.01); *B25B 13/5058* (2013.01)

(58) Field of Classification Search
CPC ..... B25B 13/44; B25B 13/18; B25B 13/12; B25B 13/46; B25B 13/5058
USPC ..... 81/3.42, 170, 176.3, 179, 128, 129
See application file for complete search history.

(56) References Cited

U.S. PATENT DOCUMENTS

| | | | | |
|---|---|---|---|---|
| 3,119,290 | A * | 1/1964 | Ivie | 81/128 |
| 3,240,086 | A * | 3/1966 | Way | 81/111 |
| 3,910,410 | A * | 10/1975 | Shaw | 220/359.3 |
| 4,012,971 | A | 3/1977 | Zeyher | |
| 4,982,629 | A * | 1/1991 | Germain | 81/176.1 |
| 5,154,102 | A * | 10/1992 | Becker | 81/3.48 |
| 5,207,131 | A | 5/1993 | Pool et al. | |
| D348,814 | S | 7/1994 | Pearson | |
| 5,845,552 | A * | 12/1998 | Piascik | 81/461 |
| 5,924,342 | A * | 7/1999 | Chou | 81/120 |
| 7,107,878 | B1 * | 9/2006 | Jerantowski | 81/121.1 |
| 7,340,979 | B2 * | 3/2008 | Sawyer | 81/3.4 |
| 8,691,085 | B2 * | 4/2014 | Ishikura | 210/130 |
| 2002/0017171 | A1 * | 2/2002 | Chang | 81/133 |
| 2007/0000353 | A1 * | 1/2007 | Yu | 81/3.4 |

(Continued)

OTHER PUBLICATIONS

Craftsman Universal Oil Filter Wrench, Auto-Adjustable, Sears.com online store link (http://www.sears.com/craftsman-universal-oil-filter-wrench-auto-adjustable/p-02820523000P?sid=IDx20070921x00003h&srccode=cii_5784816&cpncode=33-283872582-2&redirectType=SRDT), first visited Apr. 7, 2014, printed Jun. 4, 2014, 2 pages.

(Continued)

*Primary Examiner* — Hadi Shakeri
*Assistant Examiner* — Danny Hong
(74) *Attorney, Agent, or Firm* — Kilpatrick Townsend & Stockton LLP

(57) ABSTRACT

An apparatus for removing an oil filter. The apparatus includes a top plate and a bottom plate. A gear is meshed with two spring loaded clamps located between the top and bottom plate. The gear is operable by an external device to apply clamping force to an oil filter via the clamps.

6 Claims, 11 Drawing Sheets

TOP PLATE

(56) References Cited

U.S. PATENT DOCUMENTS

| | | | | |
|---|---|---|---|---|
| 2007/0131067 | A1* | 6/2007 | Wu | 81/128 |
| 2009/0229418 | A1* | 9/2009 | Garman et al. | 81/3.2 |
| 2009/0235785 | A1* | 9/2009 | Kim | 81/57.33 |
| 2012/0079919 | A1* | 4/2012 | Chen et al. | 81/90.2 |

OTHER PUBLICATIONS

Universal Oil Filter Wrench 2 1/4" to 4" Adjustable T E 4276, eBay.com (http://www.ebay.com/itm/Universal-Oil-Filter-Wrenches-2-1-4-TO-4-Adjustable-T-E-4276-/161316516243), winning bid purchased on May 31, 2014, (8 pages).

* cited by examiner

TOP PLATE

BOTTOM PLATE

TOP VIEW TOP PLATE OFF

TOP VIEW WITH SPRINGS

BOTTOM VIEW BOTTOM PLATE OFF WIDE OPEN

SIDE VIEW NO SPRINGS WIDE OPEN

OIL FILTER WRENCH

This application claims the benefit of U.S. Provisional Application No. 61/744,438, filed Sep. 20, 2012.

BACKGROUND OF THE INVENTION

The invention relates to an oil filter wrench with useful benefits in mind for removing screw-type oil filters in the automotive industry.

Oil filter wrenches come in different shapes and sizes. Some oil filter wrenches are too narrow and long to fit in a confined space. Others are bias in nature only to fit and labeled for import use only. I have used oil filter wrenches that tend to slip when slightly worn out while unscrewing oil filters at their ends or unscrewing oil filters on their middle section which tend to crush making it harder to unscrew. In some occasion oil filters are slippery when covered with engine oil and are tightly screwed on, which makes it difficult to unscrew in a tight space. All those times using different oil filter wrenches and figuring out which fits a certain vehicle oil filter location became a hassle and frustrating while losing valuable shop time.

The types of oil filter wrenches that I have encountered are the adjustable pliers-wrench which is not versatile in confined spaces. Second, the band-strap wrenches that require more room to maneuver to remove oil filters and will occasionally slip when an oil filter is wet with engine oil. Third, the oil filter wrench set, which can become cumbersome to find the right size cap to fit at the end of an oil filter during rush hours. Fourth, the three jaw wrench that requires both hands to operate while the other hand applies pressure around the tool to properly work which can be awkward in a tight space specially with both hands and will slip when let go depending on the a filter size and location.

BRIEF SUMMARY OF THE INVENTION

My oil filter wrench (the "Grappler") is assisted by a ⅜" drive ratchet in order to operate. My oil filter wrench will fit in confined spaces and tackle all sorts of screw-type oil filter sizes and different brand names starting from 2½" up to 3⅝" in size.

My oil filter wrench is not biased, which I designed with certain measurements to fit and remove oil filters on domestic and import vehicles, as well as small diesel trucks. My oil filter wrench has a quick responsive grip, two spring loaded rack gear mechanism that bites into the end of an oil filter and creates a tight grip which makes every turn count without the possibility of slipping. My oil filter wrench will improve productivity, reduce stress, and fatigue for the user in the oil change service environment. Some embodiments of my invention, which all parts, functions, shapes, and other aspects of my oil filter wrench are presented, in my specification and drawings as follows.

DETAILED DESCRIPTION OF THE INVENTION

Figure 1A:
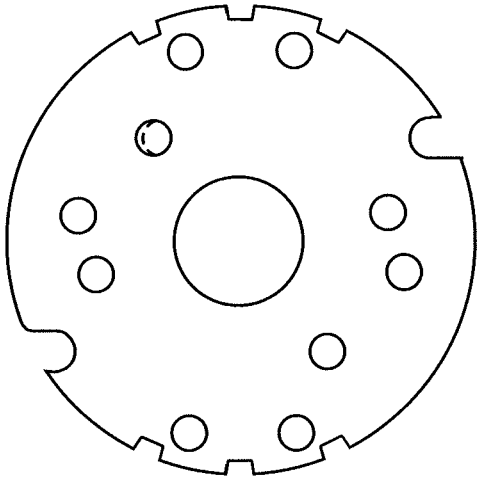
FIG. 1A show a top view of a top plate.
Figure 1B:
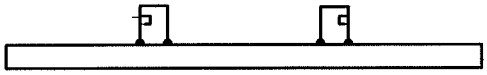
FIG. 1B shows a side view of the top plate of FIG. 1A.
Figure 1C:
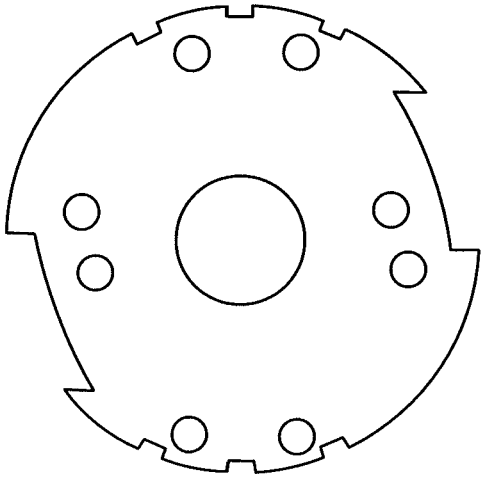
FIG. 1C shows a top view of a bottom plate.
Figure 1D:
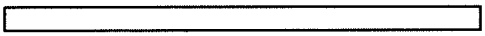
FIG. 1D shows a side view of the bottom plate of FIG. 1C.
Figure 2A:
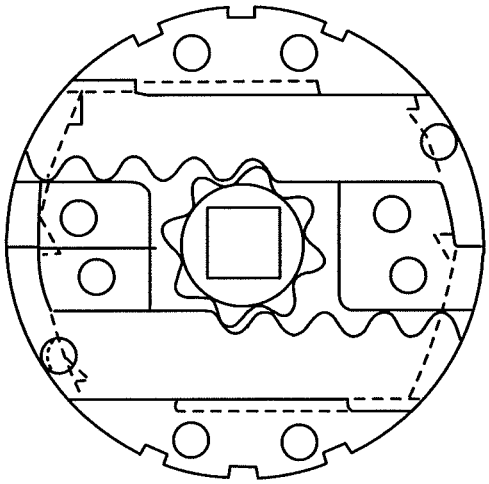
FIG. 2A shows a top view of an apparatus with a top plate removed.
Figure 2B:
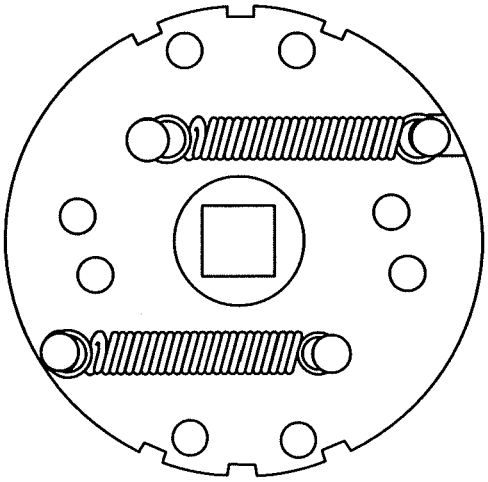
FIG. 2B shows a top view of an apparatus.
Figure 2C:
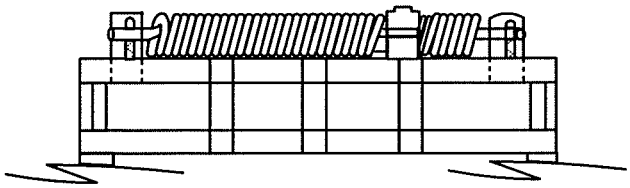
FIG. 2C shows a side view of the apparatus of FIG. 2B.
Figure 3A:
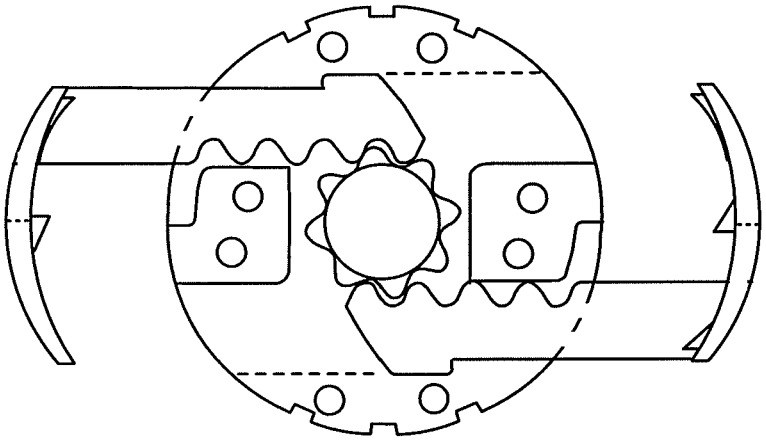
FIG. 3A shows a bottom view of an apparatus.
Figure 3B:
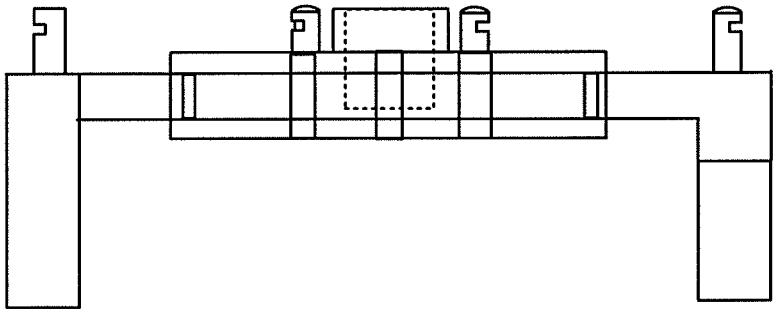
FIG. 3B shows a side view of the apparatus of FIG. 3A.
Figure 4:
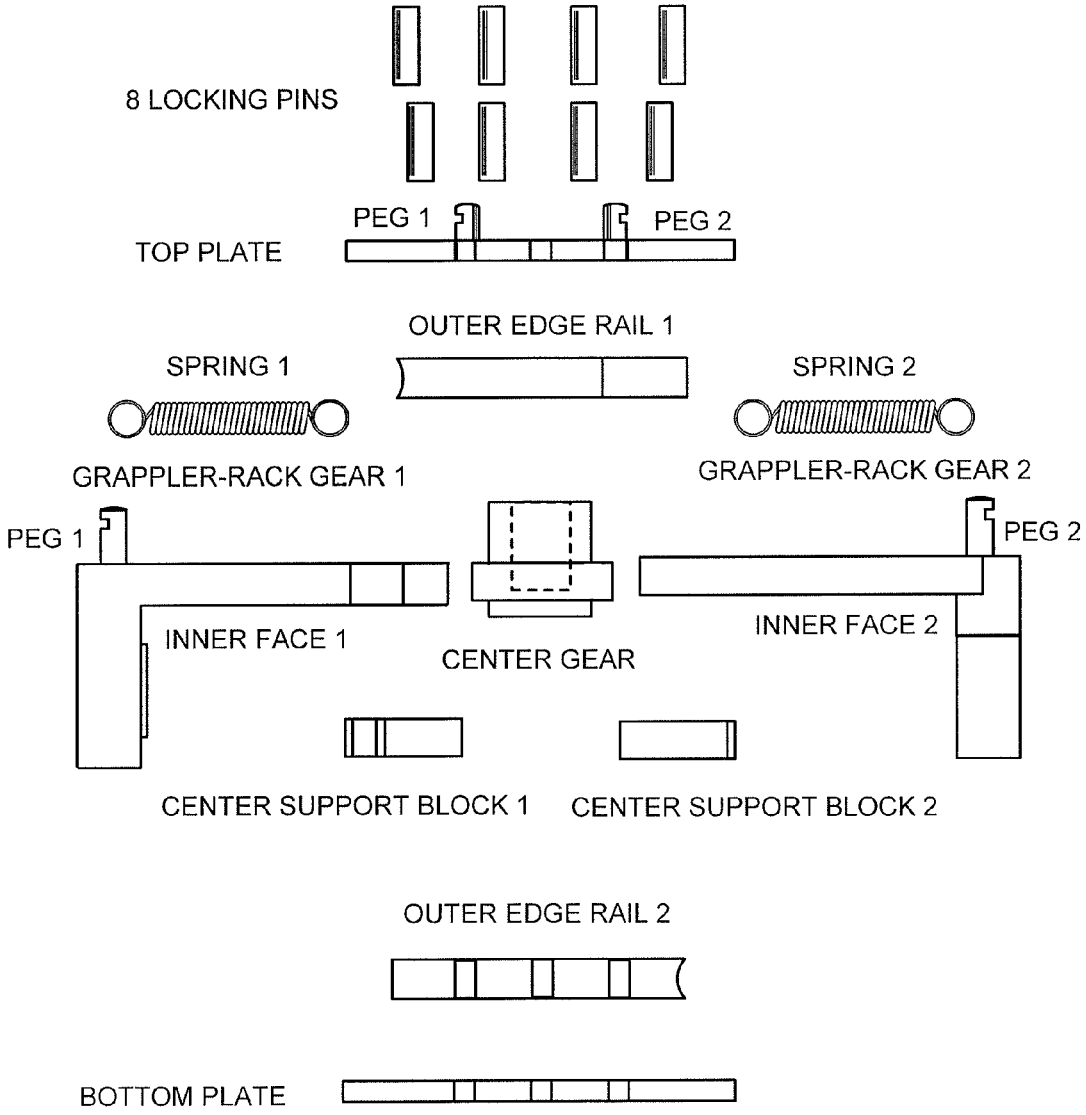
FIG. 4 shows an exploded view of an apparatus.
Figure 5A:
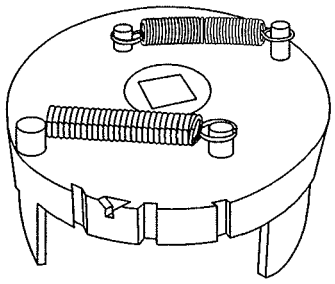
FIGS. 5A-5C show various perspective views of an apparatus.
Figure 5B:
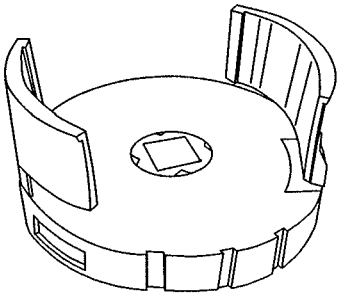
Figure 5C:
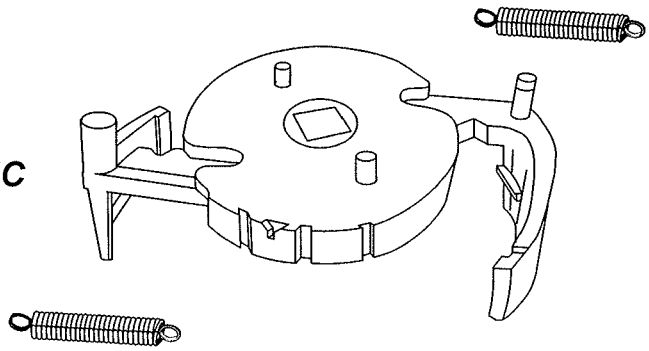
Figure 6:
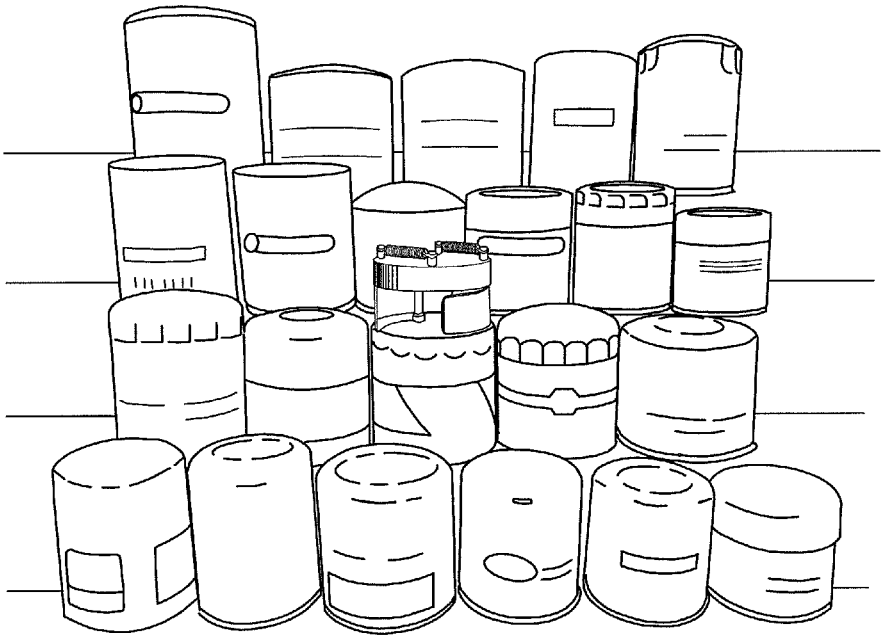
FIG. 6 shows a comparative figure of different oil filters in comparison with an apparatus for removing oil filters.

I. Exemplary Apparatus for Removing an Oil Filter

An example of apparatus for removing oil filters are depicted in FIGS. 1-5C, which are described as follows. My oil filter wrench consists of a BOTTOM PLATE ⅛" thick as a foundation for assembling for the entire oil filter wrench. It consist of eight holes 3⁄16" dia. measured to line-up with the holes on the OUTER EDGE RAIL 1 and 2, CENTER SUPPORT BLOCK 1 and 2, and the TOP PLATE that receive eight 3⁄16" dia. LOCKING PINS. It also includes one center hole 11⁄16" dia. to receive the bottom end section of the CENTER GEAR. It has two slots at the edge 27⁄32" in length and 5⁄32" deep transverse to each other identically reverse that receive the bottom corner of GRAPPLER-RACK GEAR 1 (left slot) and 2 (right slot). The BOTTOM PLATE also consist of six total grooves three on each side ⅛" by 1⁄16" transverse to each other used for gripping located on the outer edge which are ⅜" apart and line-up with the other identical grooves on the OUTER EDGE RAIL 1 and 2 and the TOP PLATE.

The OUTER EDGE RAIL 1 consist of two 3⁄16" dia. holes that are measured equally from the center out 9⁄16" apart center to center that receive two LOCKING PINS and a ¼" dia. concave arc 1⁄16" deep by 1 11⁄32" length rail that accommodate the protruding arc 7⁄32" dia. by 1⁄16" height and ⅜" in length from GRAPPLER-RACK GEAR 2 designed as a guide and a stopper. The OUTER EDGE RAIL 1 is between the BOTTOM PLATE and TOP PLATE and is transverse of OUTER EDGE RAIL 2 identically reverse. It consists of three vertical grooves that have identical measurements that match up one side of the BOTTOM PLATE and TOP PLATE.

The OUTER EDGE RAIL 2 is transverse of OUTER EDGE RAIL 1 and is identically the same, only reverse.

The GRAPPLER-RACK GEAR 1 is designed as a rack gear with four teeth facing inward measuring ⅛" dia. are and with five slots 3⁄16" dia. are and ⅛" width that mesh with the CENTER GEAR. It consist of PEG 1 which is paralleled with GRAPPLER 1 inner face 3⁄16" width by ⅜" in height that align with PEG 2 on the TOP PLATE and inserts into a slot ¼" by 7⁄32" which is transverse of PEG 2 of TOP PLATE. PEG 1 from GRAPPLER RACK GEAR 1 will receive one end of SPRING 1 while the other end of SPRING 1 connects to PEG 2 from the TOP PLATE. It consists of a stopper 7⁄32" dia. arc by 1⁄16" height by ⅜" in length that inserts into the OUTER EDGE RAIL 2. The INNER FACE 1 of GRAPPLER-RACK GEAR 1 consists of three vertical choppers. The center chopper measures at 3⁄32" in height by ⅝" length by 3⁄16" wide and two outer edge choppers measuring at 1⁄16" height by ⅝" length by 3⁄16" wide. The two choppers that are transverse located on the edges of the inner face are divided into three smaller choppers 1⁄16" apart two below are measuring at 3⁄16" by 3⁄16" and the third on top measuring at ⅛" by 3⁄16". The center chopper stays solid for integrity and is the biggest of the three choppers to compensate for the center space when gripping the end of an oil filter. The three choppers are measured and shaped this way using the 30° 60° 90° triangle method based on form and function. The 60° and 90° side is the leading edge facing towards the direction when removing an oil filter, which is counter clockwise and the 30° angle is facing opposite so the oil filter wrench can be reversed freely so the grapplers can avoid obstructions. The three choppers are ½" apart and are shaped this way to fit and maintain diverse fittings on all possible screw-type oil filter ends. The INNER FACE 1 consist of a 2½" dia. outer arc and a 3" inner dia. arc, and from ¼" away from both edges are ⅛" thick that tapers down to 3/32" at the ends.

The GRAPPLER RACK GEAR 2 is transverse of GRAPPLER-RACK GEAR 1 and is identically the same, only reverse.

The CENTER GEAR consists of eight teeth measuring at ⅛" outer dia. arc and 6/32" inner dia. arc that make-up the gear. It is ¾" in height ⅞" wide, and has a ⅜" square socket insert by 9/16" deep that will receive a ⅜" drive ratchet. The gear is horizontally off-set measuring ¼" from the bottom to center of the gear. The gear shaft is 21/32" dia. with the gear at ⅞" dia. which the teeth are measured equally apart from each other. The top end inserts into the TOP PLATE center hole and the bottom end inserts into the BOTTOM PLATE center hole. The CENTER GEAR is between the CENTER SUPPORT BLOCK 1 and 2, the OUTER EDGE RAIL 1 and 2 and is enclosed by the BOTTOM PLATE and the TOP PLATE. The CENTER GEAR is designed to turn and move the GRAPPLER-RACK GEAR 1 and 2 in unison by extracting and retracting. The CENTER GEAR is the heart of the oil filter wrench that move the GRAPPLER-RACK GEAR 1 and 2 in sequence applying pressure directly towards the center which eliminates slack and maximizes torque when removing an oil filter.

The CENTER SUPPORT BLOCK 1 consists of two 3/16" holes measured precisely and arranged to receive two 3/16" LOCKING PINS. The outer face of CENTER SUPPORT BLOCK 1 consists of an outer arc 2½" dia. and the secondary arc 2" dia. which is flushed with the surface of slot 1 that receive the inside corner of GRAPPLER-RACK GEAR 1. When the oil filter wrench is in use the CENTER SUPPORT BLOCK 1 along with CENTER SUPPORT BLOCK 2 becomes the center support between the GRAPPLER-RACK GEAR 1 and 2 and is used as a sliding rail. The 2½" dia. outer arc of CENTER SUPPORT BLOCK 1 is flushed with the edge and arc of the TOP PLATE and BOTTOM PLATE and is positioned between the two plates perfectly aligned from the edge.

The CENTER SUPPORT BLOCK 2 is transverse of CENTER SUPPORT BLOCK 1 and is identically the same, only reverse.

The TOP PLATE is the last main part to complete the oil filter wrench before sealing it with eight LOCKING PINS and connecting SPRING 1 and 2. It consist of eight holes 3/16" dia. measured precisely to line-up and receive eight 3/16" dia. LOCKING PINS. It includes one center hole 11/16" dia. two receive the top end section of the CENTER GEAR and has two slots ¼" wide by 7/32" located at the edge transverse to each other. The TOP PLATE consists of two 3/16" pegs which are part of the TOP PLATE in a permanent manner. PEG 1 from the TOP PLATE is parallel to PEG 2 of GRAPPLER-RACK GEAR 2 and measures 1 15/32" in between center to center of both pegs in a close position. PEG 2 from the TOP PLATE is parallel to PEG 1 of GRAPPLER-RACK GEAR 1 and measures 1 15/32" in between center to center of both pegs in a close position. The TOP PLATE also consist of six total ⅛" by 1/16" grooves, three on each side transverse to one another used for gripping, which are ⅜" apart and line-up with the grooves on the OUTER EDGE RAIL 1 and 2 and the BOTTOM PLATE.

There are eight LOCKING PINS chosen to connect the parts together either rivet type ends or tig welded and filed down flushed to the surface. Other means suitable to assemble my oil filter wrench is open for discussion. The eight LOCKING PINS are ½" in length and 3/16" dia. and are made to penetrate through the holes of the BOTTOM PLATE, OUTER EDGE RAIL 1 and 2, CENTER SUPPORT BLOCK 1 and 2 and the TOP PLATE while GRAPPLER-RACK GEAR 1 and 2 are contained and move freely with the CENTER GEAR inside the oil filter wrench.

SPRINGS 1 and 2 are chosen as a readily available product by SERVALITE, as a replacement parts if need to be, measuring at 1 13/32" Lgth, ¼" Out Dia.-032 Wire Gauge that suits the functionality of my oil filter wrench. SPRING 1 and SPRING 2 are transverse on the TOP PLATE. SPRING 1 is placed between GRAPPLER RACK GEAR 1 PEG 1 to PEG 2 on the TOP PLATE. SPRING 2 is placed between GRAPPLER-RACK GEAR 2 PEG 2 to PEG 1 on the TOP PLATE. SPRING 1 and 2 work together to apply tension to grapple the end of an oil filter and will hold the weight of the oil filter wrench while suspended. SPRING 1 and 2 also auto-adjust GRAPPLER RACK GEAR 1 and 2 to fit any oil filter size and different brand oil filters from 2½" up to 3⅝".

The material chosen for my oil filter wrench should be of high quality metal that has high tensile strength or any metal that can withstand the highest Ft. lbs. of torque. For example, materials such as Carbon Steel, Inconel 625 and other metals that may suit my invention. The manufacturing process, such as forging will be developed in a way to produce my invention the best way possible. The only part that does not need to be manufactured is SPRING 1 and 2 in my invention that are products by SERVALITE, a company that specializes in developing springs. As a finish product, I prefer my GRAPPLER oil filter wrench to have a chrome finish surface, if possible.

II. Methods for Removing an Oil Filter

Figure 7:
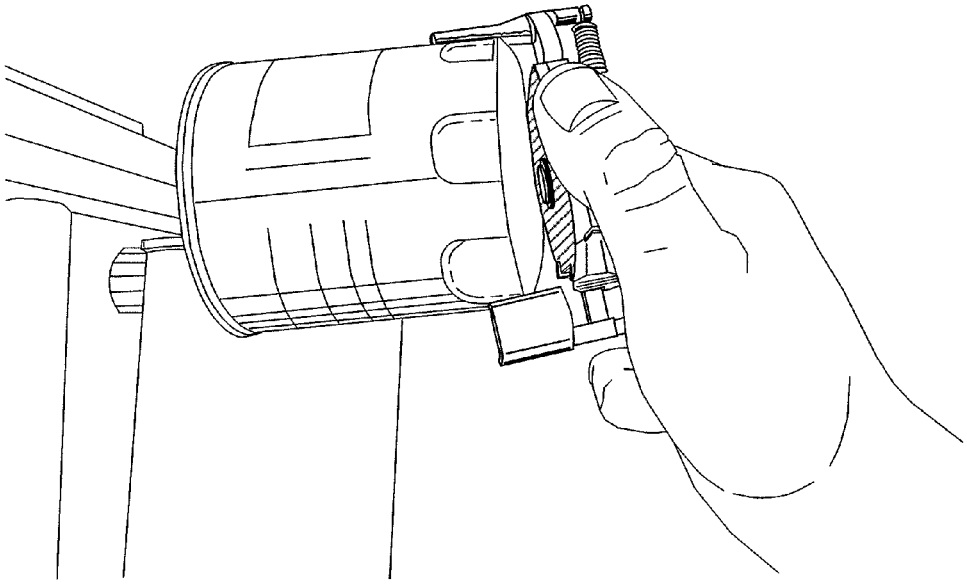
FIGS. 7-11 show various views of an apparatus for removing oil filters in use.

Exemplary figures showing methods for removing oil filters are shown in FIGS. 7-11, which are described as follows. My oil filter wrench can be applied in four different ways at the end of an oil filter. One, with a single hand holding the edge with your thumb and index finger while your middle finger, ring finger, and pinkie holds back one of the grappler and hooks the other grapplers inner face around the end of the oil filter, and then releasing the grappler that is being held back to grab flush where both grapplers are now applying pressure on their own at the end of the oil filter, as shown in FIG. 7.

Figure 8:
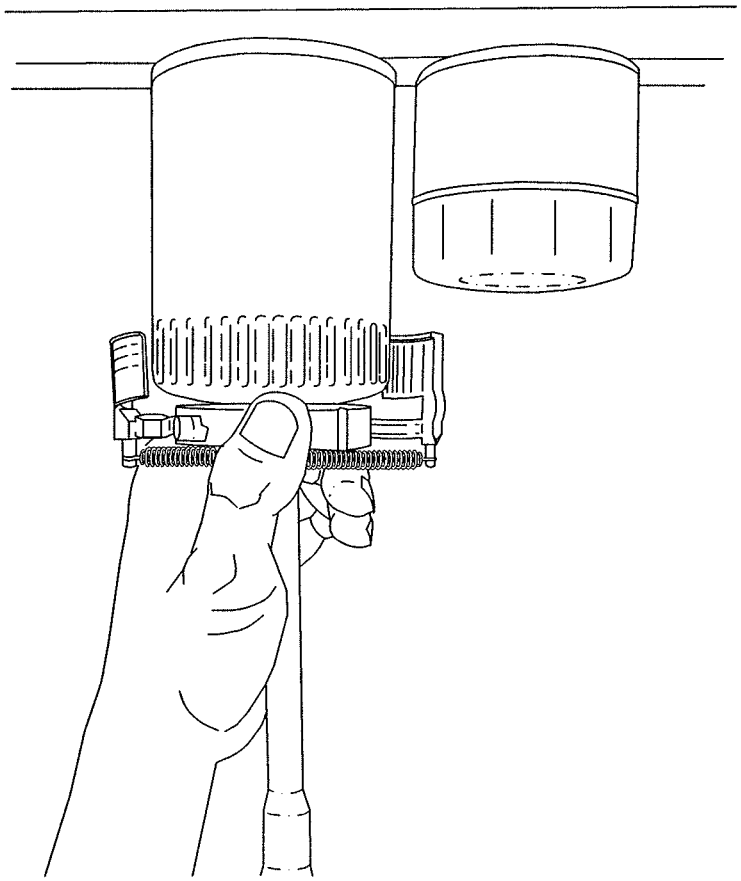
Figure 9:
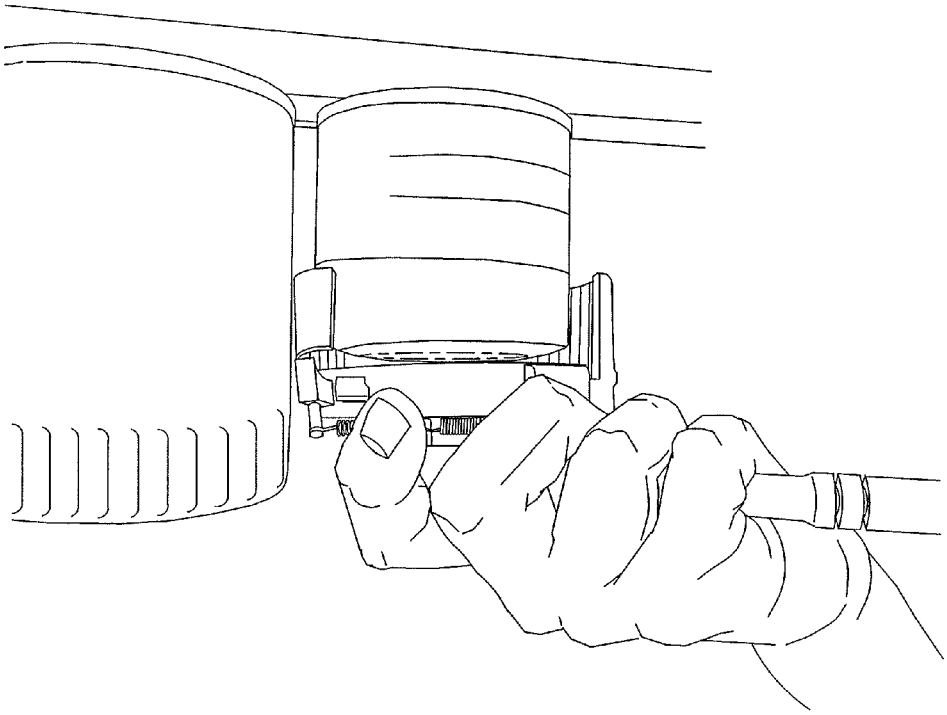
Figure 11:
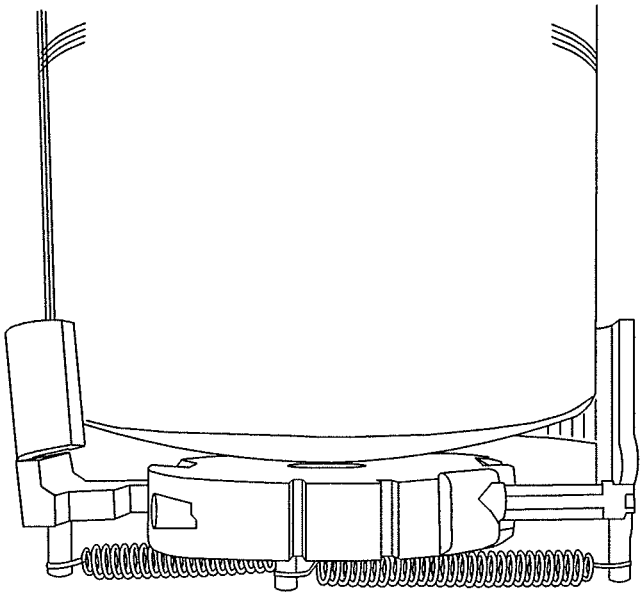

My oil filter wrench will grip on its own at the end of an oil filter without being held down to clamp with a hand, as shown in FIG. 11. Once the oil filter wrench is clamped, the user can insert the drive ratchet to unscrew the oil filter, as shown in FIGS. 8 and 9. The first application is good for 2½" dia. filters.

Figure 10:
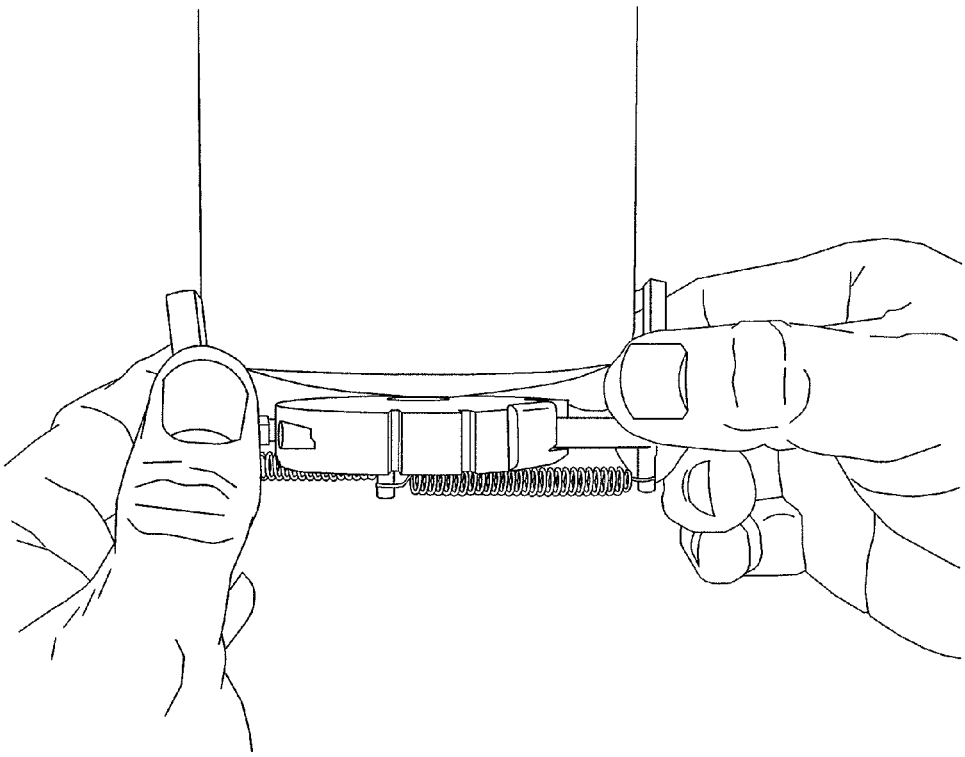

Second, the user can spread the oil filter wrench by holding a grappler with each hand facing outward while pulling them apart and applying to fit at the end of an oil filter, as shown in FIG. 10. Once the oil filter wrench is clamped at the end of the oil filter on its own a drive ratchet can now be inserted to unscrew the oil filter. The second application is good for 3" dia. oil filters up to 3⅝" dia. My oil filter wrench has the possibility of slipping off at a vertical position, but is best to use this application when the oil filter is at a 45° positive or negative angle, at a horizontal or at an upright position.

Third, by using a ⅜" drive ratchet with or without an extension bar along with a swivel socket inserted into the CENTER GEAR socket, depending on the situation, as shown in FIG. 9. The user then turns the drive ratchet clockwise by using the right hand, while the left hand holds the edge of the oil filter wrench on the grooves while the grapplers are facing out being opened at a desired size to fit at the end of the oil filter, or by forcing the oil filter wrench at the end of the oil filter while twisting the drive ratchet to the right to open and flush at the end of the oil filter. The user can then switch the drive ratchet to unscrew the oil filter.

Fourth, the user will use a ⅜" drive ratchet about 8" long or whatever length is appropriate inserted in the oil filter wrench socket, as shown in FIG. 8. The left hand holds the grooves with thumb, index, and middle finger with the palm facing the grapplers while the users' right hand turns the drive ratchet to the right and opens the grapplers at a desired size to fit onto the end of an oil filter. At this point the user keeps the position of the oil filter wrench open with the drive ratchet steady with the right hand while gripping the oil filter wrench grooves (grapplers facing outward) and flushing the oil filter wrench at the end of the oil filter.

Finally, the user can let go of the oil filter wrench with the thumb, index and middle finger around the grooves while holding the drive ratchet steady and setting the drive ratchet to turn left with thumb or index finger to unscrew the oil filter with the same hand. It will remove wet oil filters covered with engine oil in a tight space.

The invention claimed is:

1. An oil filter wrench comprising:

a bottom plate as a foundation for on oil filter wrench, the bottom plate having holes;

first and second outer edge rails mounted to the holes of the bottom plate;

first and second center support blocks mounted to the bottom plate;

a top plate pinned to the bottom plate, over the outer edge rails and center support blocks, by locking pins that extend through the outer edge rails and the center support blocks;

a center gear centrally located between the top and bottom plates;

first and second rack gears engaged with the center gear;

wherein the top plate has first and second slots that receive portions of the first and second rack gears, wherein the bottom plate comprises grooves used for gripping located on the outer edge and lined-up with the corresponding grooves on the first and second outer edge rails and the top plate, wherein first and second springs are located on the top plate, the first spring being placed between a first peg on the first rack gear and a second peg of the top plate, the second spring being paced between a third peg on the second rack gear and a fourth peg of the top plate, wherein the first and second springs work together to apply tension to grapple the end of an oil filter and hold the weight of the oil filter wrench while suspended, wherein the first and second springs auto adjust the first and second rack gears to fit a plurality of oil filter sizes.

2. The oil filter wrench of claim 1 wherein the first and second outer edge rails each consists of two holes that are measured equally from the center that receive two of the locking pins and a concave arc rail that accommodate a protruding arc from the second rack gear designed as a guide and a stopper, the first outer edge rail being between the second outer edge rail and further comprising three vertical grooves that match up one side of the bottom plate and top plate.

3. The oil filter wrench of claim 2 wherein the first and second rack gears each have four teeth facing and five slots that mesh with the center gear.

4. The oil filter wrench of claim 3 wherein the center gear consists of eight teeth and a square socket insert that can receive a drive ratchet, and is designed to turn and move the first and second rack gears in unison by extracting and retracting, which moves the first and second rack gears in sequence applying pressure directly towards the center gear which eliminates slack and maximizes torque when removing an oil filter.

5. The oil filter wrench of claim 4 wherein the first and second center support blocks each consist of two holes arranged to receive two of the locking pins, and an outer face of consists of an outer arc and a secondary arc which is flush with a surface of the first slot that receives the first rack gear.

6. The oil filter wrench of claim 5 wherein there are eight locking pins with rivet type ends or tig welded and filed down ends flushed to the surface where the eight locking pins penetrate through the holes of the bottom plate, first and second outer edge rails, first and second center support blocks, and the top plate while the first and second rack gears are contained and move freely with the center gear inside the oil filter wrench.

* * * * *